US009401251B2

(12) United States Patent
Nickerson et al.

(10) Patent No.: US 9,401,251 B2
(45) Date of Patent: Jul. 26, 2016

(54) MOLDED CASE CIRCUIT BREAKER

(75) Inventors: Douglas Alvan Nickerson, Bristol, CT (US); Jonathan Rich Doncet, Plainville, CT (US)

(73) Assignee: General Electric Company, Schenectady, NY (US)

( * ) Notice: Subject to any disclaimer, the term of this patent is extended or adjusted under 35 U.S.C. 154(b) by 378 days.

(21) Appl. No.: 13/472,886

(22) Filed: May 16, 2012

(65) Prior Publication Data

US 2013/0306454 A1 Nov. 21, 2013

(51) Int. Cl.
*H01H 9/44* (2006.01)
*H01H 9/02* (2006.01)
*H01H 77/10* (2006.01)

(52) U.S. Cl.
CPC ..... *H01H 9/446* (2013.01); *H01H 9/0264* (2013.01); *H01H 77/108* (2013.01); *H01H 77/107* (2013.01); *Y10T 29/49105* (2015.01)

(58) Field of Classification Search
CPC .... H01H 9/0264; H01H 9/446; H01H 77/108
USPC ..... 200/293, 295; 439/709, 712, 596
See application file for complete search history.

(56) References Cited

U.S. PATENT DOCUMENTS

| | | | | |
|---|---|---|---|---|
| 3,519,978 | A * | 7/1970 | Taormina et al. | 439/596 |
| 4,654,490 | A | 3/1987 | Leone et al. | |
| 4,761,626 | A | 8/1988 | Teraoka | |
| 4,970,481 | A | 11/1990 | Arnold et al. | |
| 5,548,258 | A | 8/1996 | Kuboyama et al. | |
| 6,229,413 | B1 | 5/2001 | Castonguay et al. | |
| 6,373,014 | B1 | 4/2002 | Mitsuhashi et al. | |
| 6,480,082 | B1 | 11/2002 | Aihara et al. | |
| 6,930,577 | B2 * | 8/2005 | Subramanian et al. | 335/202 |
| 6,942,527 | B1 * | 9/2005 | Lias et al. | 439/814 |
| 7,786,831 | B2 * | 8/2010 | Oh | 439/712 |
| 8,853,576 | B2 * | 10/2014 | Sisley et al. | 200/304 |
| 2011/0290624 | A1 | 12/2011 | Würgler et al. | |

FOREIGN PATENT DOCUMENTS

| | | | |
|---|---|---|---|
| CN | 86105856 | A | 2/1987 |
| CN | 201754387 | U | 3/2011 |
| CN | 103077855 | A | 5/2013 |
| EP | 0206249 | A2 | 12/1986 |
| EP | 2315228 | A1 | 4/2011 |
| JP | 201191042 | | 5/2011 |
| JP | 2011138778 | | 7/2011 |

(Continued)

OTHER PUBLICATIONS

Bosma, A. et al.; High-Voltage Live Tank Circuit-Breakers with Composite Insulators; IEEE 2000; pp. 1217-1222; vol. 3.

(Continued)

*Primary Examiner* — Felix O Figueroa
(74) *Attorney, Agent, or Firm* — General Electric Company

(57) ABSTRACT

A circuit breaker includes a housing and a line strap at least partially disposed within the housing. The line strap has a top surface and an opposing bottom surface, a first side surface and an opposing second side surface. A line strap insulator is positioned within the housing and has a first sidewall and a second sidewall. Each of the first sidewall and the second sidewall extend from a point above the line strap top surface to a point below the line strap bottom surface. The line strap insulator is fabricated from an electrically insulative material.

20 Claims, 6 Drawing Sheets

(56) References Cited

FOREIGN PATENT DOCUMENTS

| | | |
|---|---|---|
| KR | 20100047057 | 5/2010 |
| KR | 101014205 | 2/2011 |
| WO | 9949489 | 9/1999 |

OTHER PUBLICATIONS

Unofficial translation of French Search Report and Written Opinion from corresponding FR Application No. 1354354 dated May 16, 2014.

First Office Action issued in connection with Chinese Application No. 201310180895.7, dated Jan. 29, 2016, 6 pages.

Unofficial English Translation of First Office Action issued in connection with Chinese Application No. 201310180895.7, dated Jan. 29, 2016, 7 pages.

* cited by examiner

MOLDED CASE CIRCUIT BREAKER

BACKGROUND

The field of the disclosure relates generally to electrical circuit protection devices, and more particularly, to insulation for molded case circuit breakers.

A circuit breaker is an automatically operated electrical switch designed to protect an electrical circuit from damage caused by overloaded or shorted circuits. A coupler mechanism of the circuit breaker can be actuated to open and close contacts to which a load is connected. Circuit breakers have an over-current trip unit that provides over-current protection.

Electrical power enters a circuit breaker through a line strap. An insulator is used to prevent an electrical path from the line strap to any surrounding electrically conductive parts of the circuit breaker. Typically, when a contact arm of a circuit breaker is separated from the line strap during an off or "tripped" position, the line strap is at the closest point to the contact arm. Due to the line strap being close to the contact arm in the off position, electricity only needs to travel a short distance between the contact arm and the line strap to reconnect and continue the electrical current path to the armature, thus an insulative barrier is used to prevent this electrical path from reconnecting in the off position. Commonly, a voltage resistance, or breakdown test, is used to define the paths. Typically, as voltage of the line strap increases, a larger separation of the line strap and the contact arm is required to prevent the electrical path from forming. Conventionally, due to geometric and size restraints of circuit breakers, a barrier such as dielectric resistive gel (e.g., silicon rubber gel), or resistive tape is used to increase the voltage resistance of the insulator, but too much of the line strap is commonly exposed to be effectively insulated with the resistive gel, such as room temperature vulcanizing (RTV) silicon rubber gel. Such process of applying resistive gel is typically applied manually by an operator, and as such, the application of the resistive gel is operator dependent and not effectively repeatable.

BRIEF DESCRIPTION

In one aspect, a circuit breaker includes a housing and a line strap at least partially disposed within the housing. The line strap has a top surface and an opposing bottom surface, a first side surface and an opposing second side surface. A line strap insulator is positioned within the housing and has a first sidewall and a second sidewall. Each of the first sidewall and said second sidewall extend from a point above said line strap top surface to a point below said line strap bottom surface. The line strap insulator is fabricated from an electrically insulative material.

In another aspect, an assembly for a circuit breaker includes a line strap insulator including a first sidewall and an opposing second sidewall. Each of the first sidewall and the second sidewall are sized to extend from a point above a top surface of a line strap inserted between said first sidewall and said second sidewall to a point below a bottom surface of the inserted line strap. The first sidewall and the second sidewall have opposing projections. The assembly includes a line strap comprising a hole and a shunt block comprising a hole complimentary to the hole of said line strap. The projections of the line strap insulator are configured to align the hole of the line strap and the hole of the shunt block when the line strap and the shunt block are positioned within the line strap insulator.

In yet another aspect, a method of assembling a circuit breaker includes providing a circuit breaker housing and positioning a line strap insulator having a first sidewall and a second sidewall including opposing projections within the housing. A line strap is positioned at least partially within the line strap insulator and in contact with the first sidewall and the second sidewall. A shunt block is positioned at least partially within the line strap insulator such that the projections align the shunt block and the line strap in a predetermined position.

DETAILED DESCRIPTION

Figure 1:
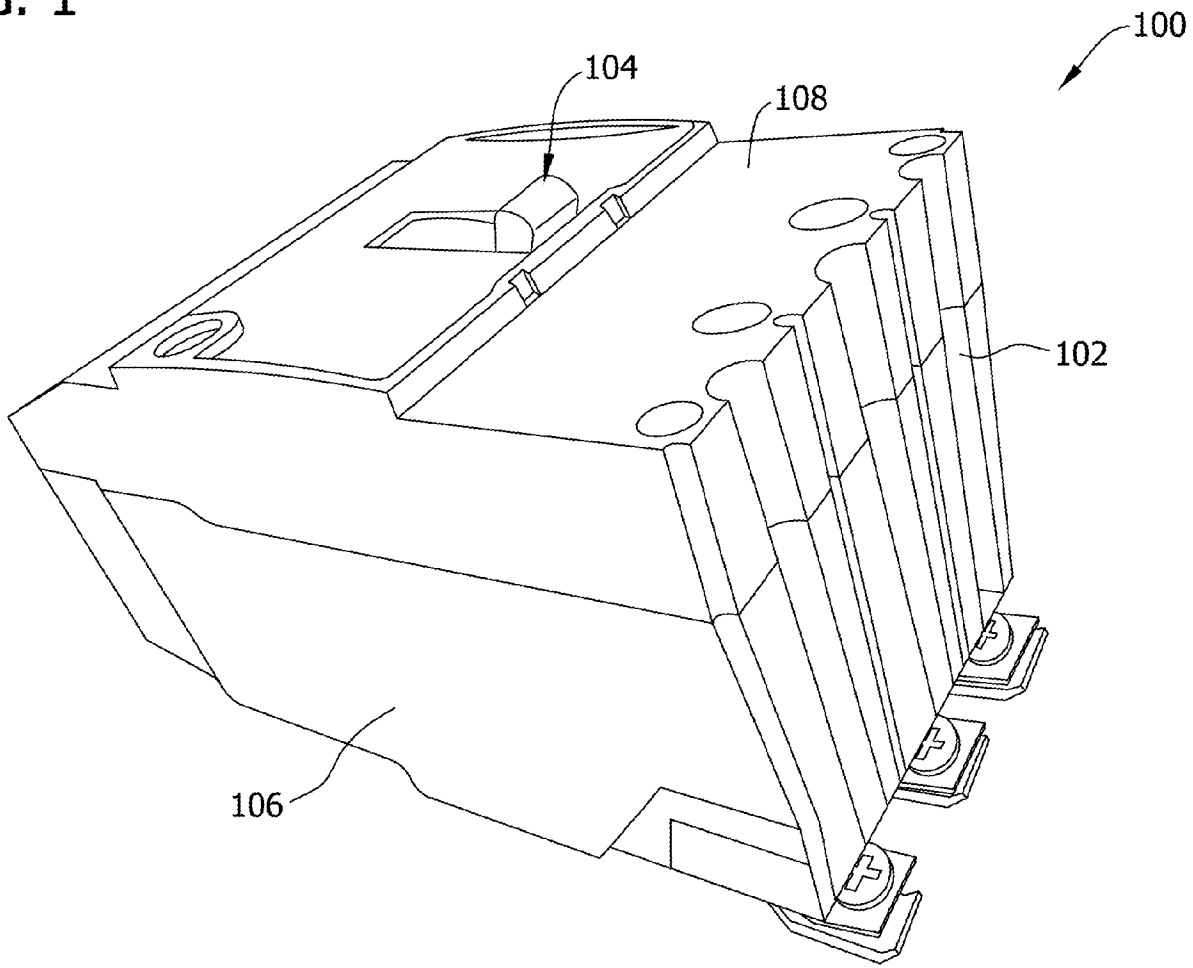
FIG. 1 is a perspective view of an exemplary circuit breaker.

FIG. 1 shows a perspective view of an embodiment of a circuit breaker 100. Circuit breaker 100 has a housing 102 that encloses an inner volume of circuit breaker 100. The housing includes a base portion 106 and a cover portion 108. A switch 104 extends through outside cover 108 and is accessible from outside housing 102. Switch 104 is used to switch circuit breaker 100 from an off position to an on position, or vice versa. Switch 104 is also used to reset circuit breaker 100 after circuit breaker 100 has tripped. FIG. 1 illustrates a three pole circuit breaker 100, however in other embodiments, circuit breaker 100 includes one or more poles.

Figure 2:
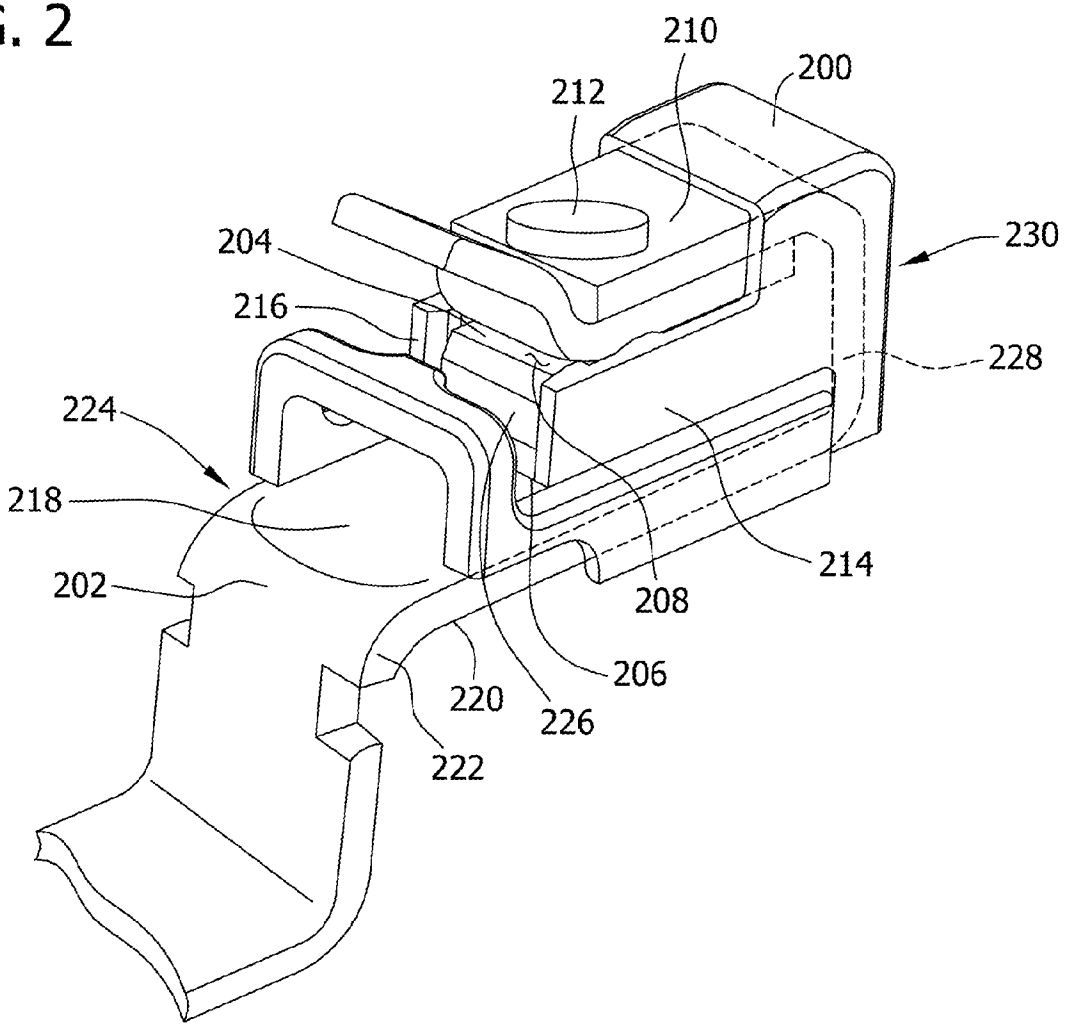
FIG. 2 is a perspective view of an exemplary line strap insulator of the circuit breaker shown in FIG. 1

FIG. 2 shows an embodiment of a line strap insulator 200. Line strap insulator 200 is sized and configured to fit within housing 102 of circuit breaker 100 (FIG. 1). In one embodiment, line strap insulator 200 is fabricated from a molded plastic material that is electrically insulative. Line strap insulator 200 is made from a casting or molding process, for example injection molding. However, line strap insulator 200 may be made from any material and process that enables circuit breaker 100 to function as described herein. In one embodiment, line strap insulator 200 is electrically insulative up to 2,500 Volts, and is sufficient for a circuit breaker rating of 480 Volts and in another embodiment, line strap insulator 200 is electrically insulative up to 3,000 Volts and is sufficient for a circuit breaker rating of 600 Volts. As used herein, "circuit breaker rating" refers to certification by Underwriter's Laboratory (UL) as a minimum voltage level before voltage creep occurs. Line strap insulator 200 is configured to insulate line strap 202 from other electrical components (not shown) of circuit breaker 100. Line strap 202 is fabricated from a conductive material, such as copper, silver, nickel, gold, aluminum, other metals or metal alloys and combinations thereof. Line strap 202 is used as the electrical input terminal for circuit breaker 100, sometimes referred to as the "hot" terminal, of circuit breaker 100. In another embodiment, a shunt block 204 is positioned within line strap insulator 200. In this embodiment, line strap insulator 200 wraps from a lower side 206 of shunt block 204 to an upper side 208 of shunt block 204. In one embodiment, line strap 202 includes a contact member mounting surface 210 located on upper side 208 of shunt block 204. A contact member 212 is coupled to contact member mounting surface 210, for example, by welding. Shunt blocks are also commonly referred to as a flux block, magnetic flux block or a flux shunt block. In embodiments, shunt block 204 is fabricated from a material that concentrates magnetic flux during a short circuit condition. The concentration of magnetic flux increases the repulsive force between line strap 202 and a contact arm (not shown) of circuit breaker 100, thereby increasing the speed at which line strap 202 is disconnected from the contact arm during a short circuit condition.

Line strap insulator 200 has a first wall 214 and an opposing second wall 216. Line strap 202 has a top face 218, a bottom face 220, a first sidewall 222 and an opposing second sidewall 224. Line strap 202 is insertable into line strap insulator 200, such that at least first sidewall 222 and second sidewall 224 are substantially covered by first wall 214 and second wall 216. In the exemplary embodiment, line strap insulator 200 has a vertical portion 228, formed by two substantially ninety degree bends, such line strap 202 has a substantially u-shaped longitudinal cross section. In one embodiment, the first wall 214 and second wall 216 extend from a point above the top face 218 of line strap 202 to a point below the bottom face of said line strap to insulate line strap 202. As used herein, "above" and below" refer to vertical directions when line strap insulator 200 is in an upright orientation, for example, as shown in FIG. 2. In another embodiment, rear section 230 of line strap insulator 200 extends rearward beyond vertical portion 228 of line strap 202 to insulate line strap 202. In one embodiment, line strap 202 is insulated by line strap insulator 200 without the use of dielectric paste. In another embodiment, first sidewall 222 is in direct contact with first wall 214 and the second sidewall 224 is in direct contact with second wall 216.

Figure 3:
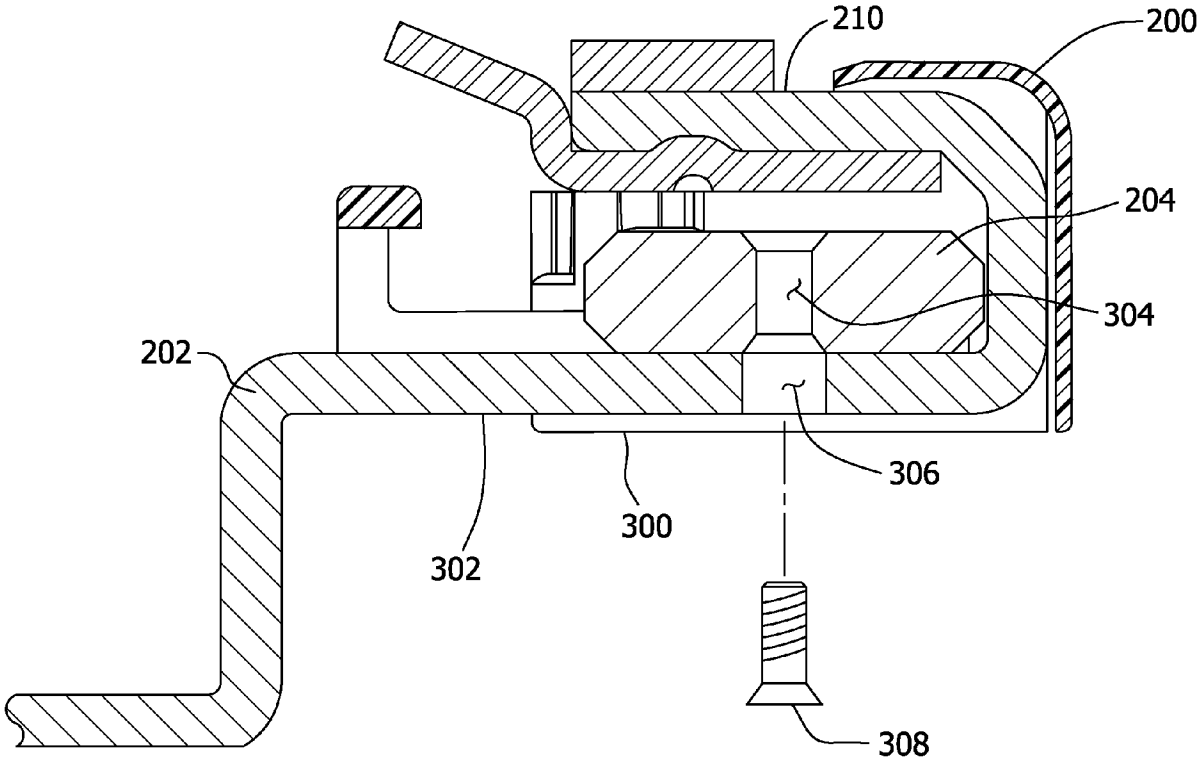
FIG. 3 is a cross section of the line strap insulator shown in FIG. 2.

FIG. 3 shows a side view of line strap insulator 200 in an upright orientation. In the embodiment shown, line strap insulator 200 is sized such that a lowermost edge 300 of line strap insulator 200 extends below a lowermost edge 302 of line strap 202. In the exemplary embodiment, shunt block 204 includes a hole 304, which may be threaded. Line strap 202 includes a complimentary hole 306 configured to align with hole 304 when shunt block 204 and line strap 202 are positioned in line strap insulator 200. A fastener 308 is inserted into holes 304 and 306 to couple line strap 202 to shunt block 204. Fastener 308 may be a screw, bolt, pin, or other fastener capable of coupling line strap 202 to shunt block 204.

Figure 4:
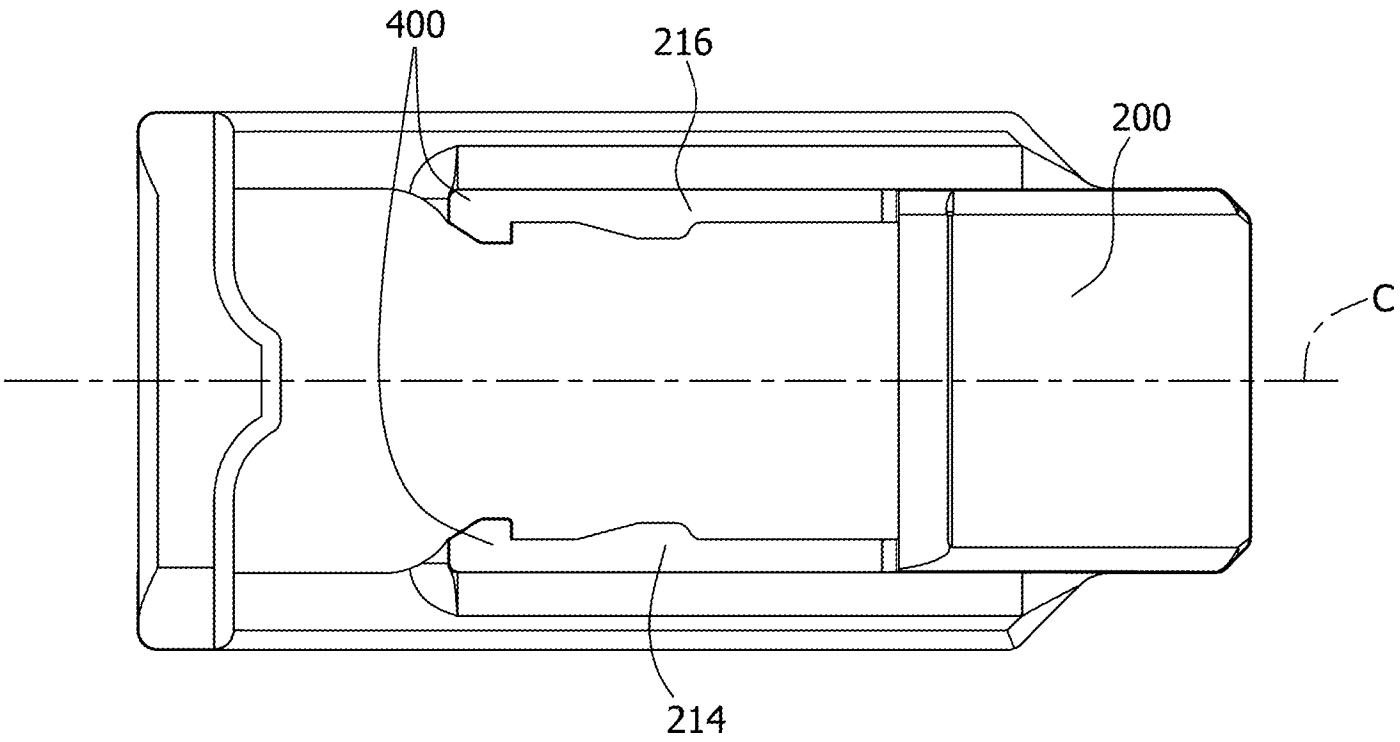
FIG. 4 is a top view of the line strap insulator shown in FIG. 2.

FIG. 4 shows a top view of an embodiment of line strap insulator 200. In one embodiment, first wall 214 and second wall 216 have one or more projections 400 extending inwardly therefrom and facing shunt block 204. As used herein, "inward" refers to a direction toward a central axis C of line strap insulator 200. Projections 400 are configured to align shunt block 204 and line strap insulator 200 such that hole 304 and hole 306 (shown in FIG. 3) are aligned with one another. Projections 400 thus allow a user to couple line strap 202 to shunt block 204 using fastener 308, without misalignment. In another embodiment, projections 400 are configured for snap-fit engagement with a front face 226 (FIG. 2) of shunt block 204. As used herein, the term "snap-fit" refers to a frictional engagement amongst two or more components, wherein at least one component flexes when the components are being joined, and snaps into place once the components are engaged. In another embodiment, shunt block 204 is configured to have recesses corresponding to projections 400. Projections 400 are configured to substantially prevent translational movement of shunt block 204 along longitudinal centerline C.

Figure 5:
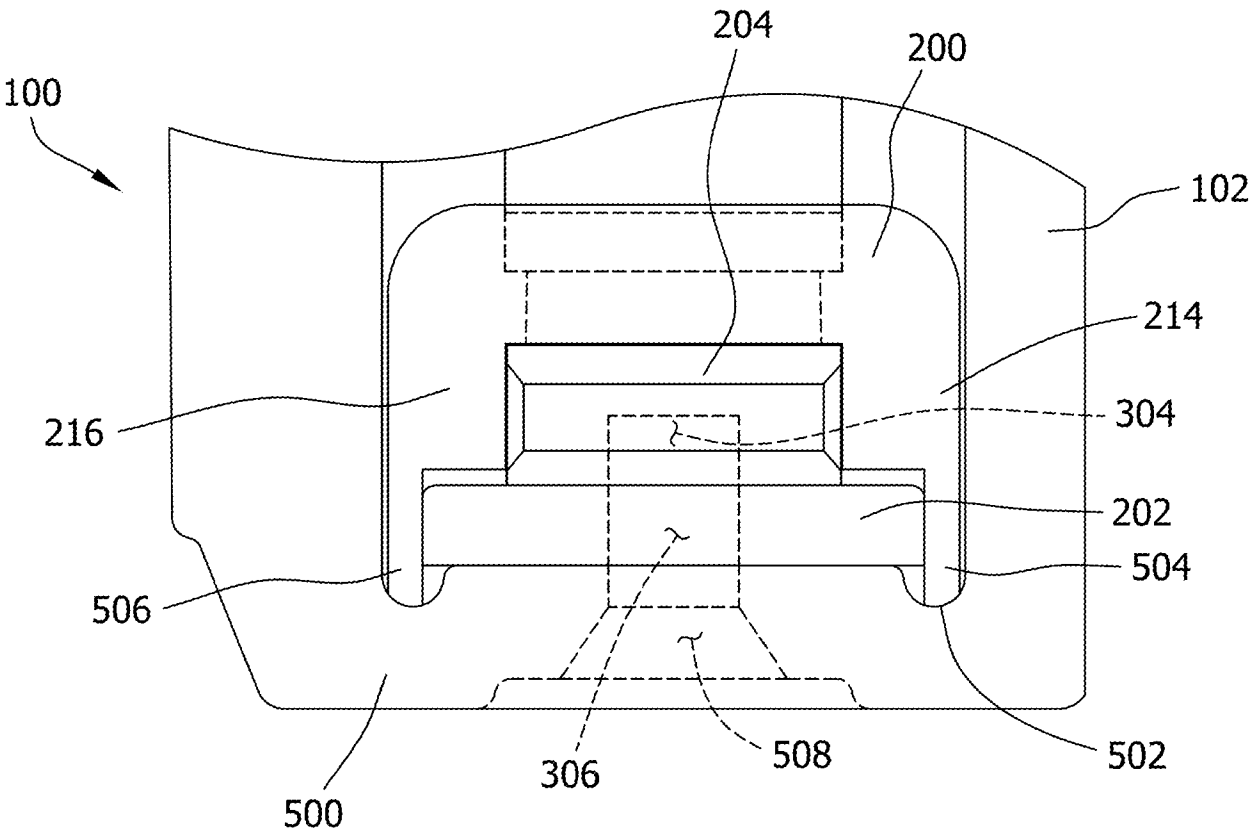
FIG. 5 is a front view of the line strap insulator shown in FIG. 2 installed in a circuit breaker.

FIG. 5 shows a cross section of circuit breaker 100 having line strap insulator 200 installed therein. In one embodiment, line strap insulator 200 is contained entirely within housing 102 of circuit breaker 100. At least a lower portion 500 of base 106 of housing 102 is in direct contact with line strap insulator 200. In another embodiment, rear section 230 (shown in FIG. 2) of line strap insulator 200 extends rearward and is in direct contact with lower portion 500. In another embodiment, housing 102 includes a retention member that cooperates with at least one of first wall 214 and second wall 216 of line strap insulator 200 for retaining line strap insulator 200 in housing 102. In one embodiment, the retention member includes grooves 502 formed in base 500. Grooves 502 are substantially parallel and extend longitudinally within lower portion 500 of housing 102. Grooves 502 are sized and configured for seating engagement with a lower edges 504 and 506 of first wall 214 and second wall 216, respectively. In one embodiment, when lower edges 504 and 506 are seated with (i.e., in an overlapping engagement with) grooves 502 of first wall 214 and second wall 216, line strap insulator 200 is held by a friction fit within base 500. The overlapping engagement of lower edges 504 and 506 with grooves 502 increases the insulation between line strap insulator 200 and other electrical components of circuit breaker 100. In another embodiment, additional grooves are formed in lower portion 500 for engagement with rear section 230 for additional insulation of line strap 202. In yet another embodiment, retention member of housing 102 includes one or more ridges, and at least one of first wall 214 and second wall 216 include a groove that cooperates with at least one of the ridges to retain line strap insulator 200 in housing 102.

In one embodiment, lower portion 500 includes a hole 508 configured to align with hole 304 and hole 306 when line strap insulator 200, line strap 202 and shunt block 204 are placed within housing 102. In this embodiment, when lower edges 504 and 506 are seated with (i.e., in an overlapping engagement with) grooves 502 of first wall 214 and second wall 216, line strap insulator 200 is held by a friction fit within base 500 in an orientation such that hole 508, hole 304 and hole 306 are aligned. Such alignment allows a user to secure housing 102 to line strap 202 and shunt block 204 using fastener 308 (shown in FIG. 3).

Figure 6:
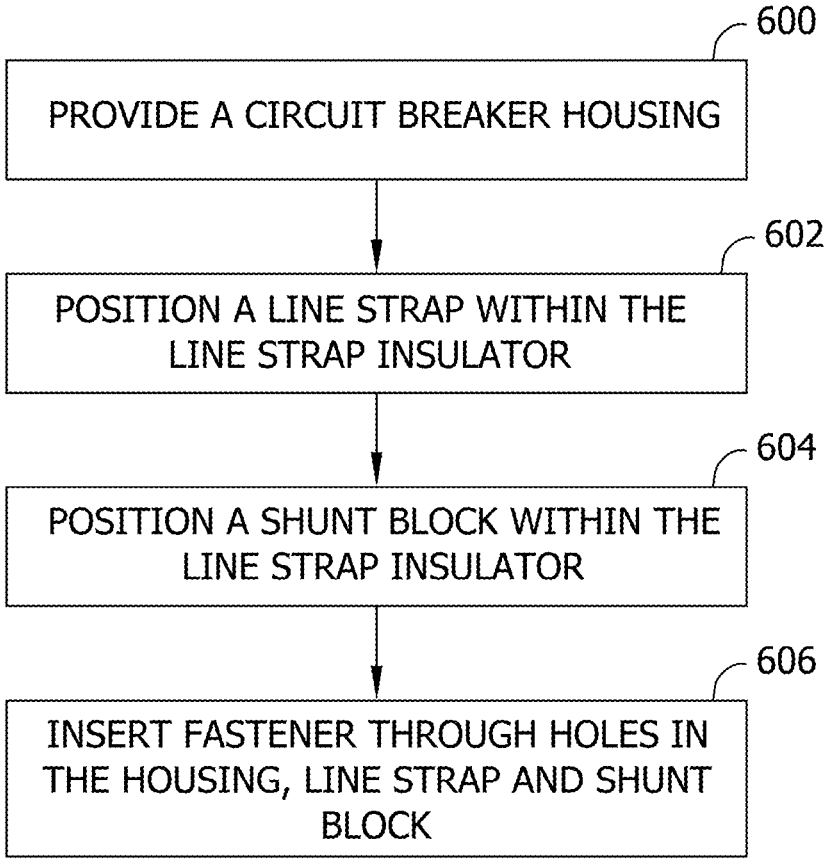
FIG. 6 is a block diagram of an exemplary method of assembling the circuit breaker shown in FIG. 1.

FIG. 6 is a block diagram of an exemplary method of assembling circuit breaker 100. In one embodiment a circuit breaker housing 102 is provided 600. A line strap 202 is positioned 602 within the line strap insulator 200. In one embodiment, shunt block 204 is then positioned within line strap insulator 200 and subsequently, the line strap insulator having the line strap 202 and shunt block 204 positioned therein is positioned within the lower portion 500 of housing 102. In one embodiment, line strap 202 is positioned at least partially within line strap insulator 200 and is in contact with first sidewall 222 and said second sidewall 224 such that each of the first sidewall and the second sidewall extend from a point above a top surface of the line strap to a point below a bottom surface of the line strap. In one embodiment, the method includes inserting 606 fastener 308 through hole 508, hole 306 and hole 304 to couple the base 500 to the line strap 202 and shunt block 204. In another embodiment, first sidewall and the second sidewall comprise opposing projections, and the method further includes positioning 604 a shunt block 204 (shown in FIG. 2) within the line strap insulator 200 (shown in FIG. 2) such that each of projections 400 face the shunt block, and projections 400 (shown in FIG. 4) hold shunt block 204 in a predetermined position, for example to align at least two of hole 304 (shown in FIG. 3), hole 306 and hole 508. In yet another embodiment, positioning shunt block 204 includes snap-fitting shunt block 204 with projections 400. In yet another embodiment, a user may first put line strap 202

(shown in FIG. 2) into line strap insulator 200 outside of housing 102 (shown in FIG. 1). Then shunt block 204 is slid along line strap surface 218 (shown in FIG. 2) until it snaps into place within line strap insulator 200. As an assembly, it is now put into place within housing 102, for example by placing the assembly into grooves 502 as described above. Once the assembly is pressed and aligned in base 102, fastener 308 is inserted from outside of housing 102 through hole 508, hole 306 and hole 304 to secure the assembly to housing 102. In other embodiments, positioning of line strap 200, shunt block 204 and line strap insulator 200 within housing 102 is performed in any order that allows the circuit breaker to function as described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A circuit breaker, comprising:

a housing;

a line strap at least partially disposed within said housing, said line strap having a top surface and an opposing bottom surface spaced apart from said top surface by a gap, a first side surface and an opposing second side surface, and a vertically extending portion connecting said top surface to said bottom surface;

a single-piece line strap insulator positioned within said housing and having a first sidewall and a second sidewall fixedly coupled to said first sidewall, wherein said second sidewall is spaced from said first sidewall in a first direction, each of said first sidewall and said second sidewall extend from a point above said line strap top surface to a point below said line strap bottom surface such that said top surface and said bottom surface are at least partially enclosed within said line strap insulator, wherein said line strap insulator is fabricated from an electrically insulative material, and wherein said line strap is configured to be inserted between said first sidewall and said second sidewall in a second direction substantially perpendicular to the first direction while said first and second sidewalls are fixed relative to one another.

2. The circuit breaker according to claim 1, wherein said housing comprises a retention member, at least one of said first sidewall and said second sidewall cooperating with said retention member to retain said line strap insulator in said housing.

3. The circuit breaker according to claim 1, further comprising a shunt block disposed within the gap between said line strap top surface and said line strap bottom surface, said shunt block configured to concentrate magnetic flux during a short circuit condition, said first sidewall and said second sidewall in contact with said shunt block.

4. The circuit breaker according to claim 3, wherein said first sidewall and said second sidewall comprise opposing projections, each of said projections facing said shunt block.

5. The circuit breaker according to claim 4, wherein said shunt block is configured to be inserted between said first and second sidewalls in the second direction, and each said projection is configured to inhibit movement of said shunt block in the second direction and hold said shunt block in a predetermined position.

6. The circuit breaker according to claim 5, wherein said shunt block is held by a snap-fit of said opposing projections contacting a face of said shunt block.

7. The circuit breaker according to claim 1, wherein said housing comprises at least two grooves, said first sidewall seated in one of said grooves and said second sidewall seated in another one of said grooves, wherein said line strap insulator is entirely within said housing.

8. The circuit breaker according to claim 1, wherein said line strap insulator is fabricated from an insulative plastic material capable of electrically insulating at least 2,500 Volts.

9. The circuit breaker according to claim 1, wherein said line strap insulator is fabricated from an insulative plastic material capable of electrically insulating at least 3,000 Volts.

10. The circuit breaker according to claim 1, wherein said line strap insulator has a cross-section that is substantially U-shaped.

11. The circuit breaker according to claim 1, wherein said line strap insulator further comprises a rear section extending between said first sidewall and said second sidewall, wherein said second sidewall is fixedly coupled to said first sidewall by said rear section.

12. An assembly for a circuit breaker, comprising:

a line strap comprising a hole, a single-piece line strap insulator including a first sidewall and an opposing second sidewall fixedly coupled to said first sidewall, wherein said second sidewall is spaced from said first sidewall in a first direction, said line strap configured to be inserted between said first sidewall and said second sidewall in a second direction substantially perpendicular to the first direction while said first and second sidewalls are fixed relative to one another, each of said first sidewall and said second sidewall are sized to extend from a point above a top surface of said line strap when said line strap is inserted between said first sidewall and said second sidewall to a point below a bottom surface of said inserted line strap, said first sidewall and said second sidewall having opposing projections, a shunt block comprising a hole similar to the hole of said line strap, wherein said projections of said line strap insulator are configured to align the hole of the line strap and the hole of the shunt block when the line strap and the shunt block are positioned within the line strap insulator.

13. The assembly according to claim 12, wherein said first sidewall and said second sidewall are configured to be seated within corresponding grooves in a base of a circuit breaker housing.

14. The assembly according to claim 12, wherein said first sidewall and said second sidewall comprise an electrically insulative material.

15. The assembly according to claim 14, wherein said shunt block is configured to be inserted between said first and second sidewalls in the second direction, said projections are configured for a snap-fit engagement with said shunt block, and said projections substantially prevent translational movement of said shunt block in the second direction when snap-fit with said shunt block.

16. The assembly according to claim 12, wherein said line strap insulator is fabricated from an insulative plastic material capable of electrically insulating at least 2,500 Volts.

17. The assembly according to claim 12, wherein said line strap insulator is fabricated from an insulative plastic material capable of electrically insulating at least 3,000 Volts.

18. A method of assembling a circuit breaker, comprising:

providing a circuit breaker housing;

positioning a single-piece line strap insulator having a first sidewall and a second sidewall including opposing projections within the housing, the second sidewall fixedly coupled to the first sidewall and spaced from the first sidewall in a first direction;

inserting a line strap at least partially within the line strap insulator and in contact with the first sidewall and the second sidewall, the line strap including a top surface and an opposing bottom surface spaced apart from the top surface by a gap, wherein the line strap is inserted between the first sidewall and the second sidewall such that each of the first sidewall and the second sidewall extend from a point above the top surface to a point below the bottom surface, wherein the line strap is inserted between the first sidewall and the second sidewall in a second direction substantially perpendicular to the first direction while the first and second sidewalls are fixed relative to one another;

positioning a shunt block within the gap between the top surface and the bottom surface of the line strap and at least partially within the line strap insulator such that the projections align the shunt block and the line strap in a predetermined position.

19. The method according to claim 18, wherein positioning a single-piece line strap insulator comprises seating the first sidewall in a groove formed within the housing and seating the second sidewall within another groove formed within the housing.

20. The method according to claim 18, wherein the predetermined position aligns a hole of the line strap with a hole of the shunt block and a hole of the circuit breaker housing, and the method further comprises inserting a fastener through the hole of the housing, the hole of the line strap and the hole of the shunt block.

* * * * *